US010254684B2

(12) United States Patent
Watanabe et al.

(10) Patent No.: US 10,254,684 B2
(45) Date of Patent: Apr. 9, 2019

(54) IMAGE FORMING DEVICE WITH FIRST AND SECOND TRANSFER POWER SOURCES

(71) Applicant: FUJI XEROX CO., LTD., Tokyo (JP)

(72) Inventors: Kanji Watanabe, Kanagawa (JP); Daisuke Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/916,321

(22) Filed: Mar. 9, 2018

(65) Prior Publication Data

US 2019/0079433 A1 Mar. 14, 2019

(30) Foreign Application Priority Data

Sep. 13, 2017 (JP) ..... 2017-176110

(51) Int. Cl.
*G03G 15/16* (2006.01)
*G03G 15/00* (2006.01)

(52) U.S. Cl.
CPC ..... *G03G 15/161* (2013.01); *G03G 15/657* (2013.01); *G03G 2215/1661* (2013.01)

(58) Field of Classification Search
CPC ..... G03G 15/1605; G03G 15/161; G03G 15/1675; G03G 15/168; G03G 15/5029; G03G 15/657; G03G 2215/00763; G03G 2215/1661
USPC ..... 399/66, 308
See application file for complete search history.

(56) References Cited

U.S. PATENT DOCUMENTS

| | | | | |
|---|---|---|---|---|
| 6,404,998 | B1 | 6/2002 | Tanaka et al. | |
| 2013/0164011 | A1* | 6/2013 | Nakamura | G03G 15/1675 399/66 |
| 2014/0010562 | A1* | 1/2014 | Tanaka | G03G 15/1675 399/66 |
| 2015/0212453 | A1* | 7/2015 | Tanaka | G03G 15/1675 399/66 |
| 2016/0154345 | A1* | 6/2016 | Nagata | G03G 15/1605 399/315 |
| 2017/0123359 | A1* | 5/2017 | Monde | G03G 15/5029 |

FOREIGN PATENT DOCUMENTS

| | | | |
|---|---|---|---|
| JP | 7-333926 | A | 12/1995 |
| JP | 2000-131961 | A | 5/2000 |
| JP | 4532629 | B2 | 8/2010 |

* cited by examiner

*Primary Examiner* — Sophia S Chen
(74) *Attorney, Agent, or Firm* — Sughrue Mion, PLLC

(57) ABSTRACT

An image forming device includes an image carrier carrying an image, a transfer device including paired transfer members that transport the image carrier and a recording medium, a grounded guide member that guides the recording medium to a transfer region, and a transfer power source that produces an electric field in the transfer region causing the image to be transferred onto the recording medium. The transfer power source includes a first transfer power source that imparts a first transfer voltage to one of the paired transfer members, and a second transfer power source that, when the recording medium has a predetermined resistance value or less, or is of low resistance having a conductive layer along a medium substrate face, imparts a second transfer voltage of opposite polarity and having an absolute value less than or equal to the first transfer voltage to the other of the paired transfer members.

9 Claims, 11 Drawing Sheets

IMAGE FORMING DEVICE WITH FIRST AND SECOND TRANSFER POWER SOURCES

CROSS-REFERENCE TO RELATED APPLICATIONS

This application is based on and claims priority under 35 USC 119 from Japanese Patent Application No. 2017-176110 filed Sep. 13, 2017.

BACKGROUND

Technical Field

The present invention relates to an image forming device.

SUMMARY

According to an aspect of the invention, there is provided an image forming device including: a thin-walled image carrier that movably carries an image formed by charged imaging particles; a transfer device that includes paired transfer members that sandwich and transport the image carrier and a recording medium, and transfers the image carried on the image carrier in a transfer region sandwiched by the paired transfer members; a guide member, provided in a grounded state farther upstream in a transport direction of the recording medium than the transfer region of the transfer device, that guides the recording medium to the transfer region; and a transfer power source that causes a transfer electric field to act in the transfer region by imparting a transfer voltage between the paired transfer members. The transfer power source includes a first transfer power source that imparts a first transfer voltage used normally to either one of the paired transfer members, and a second transfer power source that activates together with the first transfer power source when the recording medium has a predetermined resistance value or less, or is of low resistance having a conductive layer along a medium substrate face, the second transfer power source imparting a second transfer voltage of opposite polarity from the first transfer voltage and having an absolute value that is less than or equal to the first transfer voltage to the other of the paired transfer members.

BRIEF DESCRIPTION OF THE DRAWINGS

Exemplary embodiments of the present invention will be described in detail based on the following figures, wherein:

FIGS. 8A to 8C schematically illustrate a transfer operation sequence with respect to low-resistance paper in the secondary transfer unit by the image forming device according to Exemplary Embodiment 1, in which FIGS. 8A to 8C are explanatory diagrams illustrating the state before the trailing end of a paper sheet passes through an earlier guide chute, the state after the trailing end of the paper sheet passes through the earlier guide chute, and the state while the trailing end of the paper sheet is passing through a secondary transfer region, respectively;

FIGS. 9A to 9C schematically illustrate a transfer operation sequence with respect to low-resistance paper in the secondary transfer unit by an image forming device according to Comparative Embodiment 1, in which FIGS. 9A to 9C are explanatory diagrams illustrating the state before the trailing end of a paper sheet passes through an earlier guide chute, the state after the trailing end of the paper sheet passes through the earlier guide chute, and the state while the trailing end of the paper sheet is passing through a secondary transfer region, respectively;

DETAILED DESCRIPTION

Overview of Exemplary Embodiments

Figure 1:
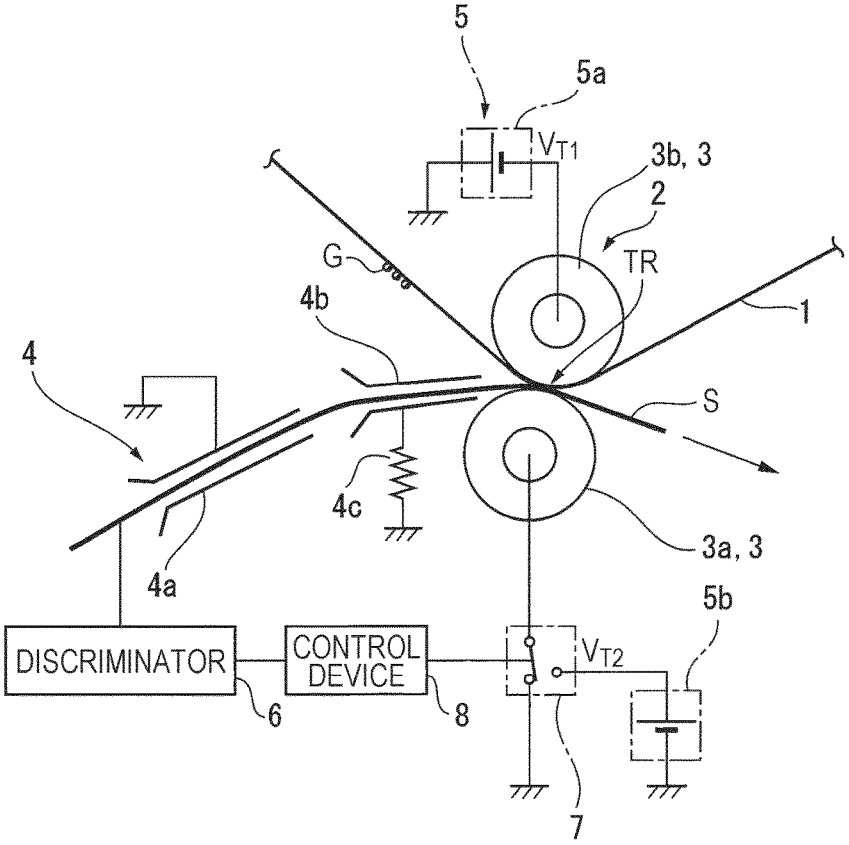
FIG. 1 is an explanatory diagram illustrating an overview of an exemplary embodiment of an image forming device to which the present invention is applied.

FIG. 1 is an explanatory diagram illustrating an overview of an exemplary embodiment of an image forming device to which the present invention is applied.

In the drawing, the image forming device is provided with: a thin-walled image carrier 1 that movably carries an image G formed by charged imaging particles; a transfer device 2 that includes paired transfer members 3 (specifically, 3*a* and 3*b*) that sandwich and transport the image carrier 1 and a recording medium S, and transfers the image G carried on the image carrier 1 in a transfer region TR sandwiched by the paired transfer members 3 (3*a* and 3*b*); a guide member 4, provided in a grounded state farther upstream in a transport direction of the recording medium S than the transfer region TR of the transfer device 2, that guides the recording medium S to the transfer region TR; and a transfer power source 5 that causes a transfer electric field to act in the transfer region TR by imparting a transfer voltage between the paired transfer members 3 (3*a* and 3*b*). The transfer power source 5 includes a first transfer power source 5*a* that imparts a first transfer voltage $V_{T1}$ used normally to one transfer member 3*a* of the paired transfer members 3 (3*a* and 3*b*), and a second transfer power source 5*b* that activates together with the first transfer power source 5*a* when the recording medium S has a predetermined resistance value or less, or is of low resistance having a conductive layer along a medium substrate face, the second transfer power source 5*b* imparting a second transfer voltage $V_{T2}$ of opposite polarity from the first transfer voltage $V_{T1}$ and having an absolute value that is less than or equal to the first transfer voltage $V_{T1}$ to the other transfer member 3*b* of the paired transfer members 3 (3*a* and 3*b*).

In such a technical configuration, insofar as the image carrier 1 carries the image G, the image carrier 1 obviously includes an intermediate transfer body of the intermediate transfer method, but also broadly includes a photoreceptor and a dielectric of the direct transfer method. Also, the form of the image carrier 1 is not limited to being belt-shaped, and may also include a thin-walled drum shape.

Also, the paired transfer members 3 (3*a* and 3*b*) broadly include members provided with a function of sandwiching and transporting the image carrier 1 and the recording medium S, obviously including a combination of a transfer roller and an opposing roller, and a combination of a transfer belt and an opposing roller. However, the transfer member 3*a* positioned on the front side of the image carrier 1 may also be a movable member, while the transfer member 3*b* positioned on the back side of the image carrier 1 may also be a stationary member.

Furthermore, although FIG. 1 illustrates a mode in which the guide member 4 is divided into a first guide member 4*a* and a second guide member 4*b*, the guide member 4 is not limited thereto, and may also not be divided into two members, or may also be divided into three or more members.

Also, it is sufficient for the transfer power source 5 to include at least the first transfer power source 5*a* and the second transfer power source 5*b*, and the transfer power source 5 may also include power sources for other purposes.

Herein, it is sufficient for the second transfer voltage $V_{T2}$ to be of opposite polarity from the first transfer voltage $V_{T1}$ and to have an absolute value that is less than or equal to the first transfer voltage $V_{T1}$, but it is sufficient for the first transfer voltage $V_{T1}$ to be set to satisfy the transfer voltage condition used normally in the case in which the recording medium S is not low-resistance, and it is sufficient for the second transfer voltage $V_{T2}$ to be chosen to supplement the first transfer voltage $V_{T1}$ in the case in which the recording medium S is low-resistance, and also to suppress the leakage of transfer current going towards the guide member 4 through the recording medium S.

Note that in this example, a mode is illustrated in which the first transfer voltage $V_{T1}$ is imparted to one transfer member 3*a* and the transfer voltage $V_{T2}$ is imparted to the other transfer member 3*b*, but obviously the relationship of the transfer members 3 with respect to the imparted first transfer voltage $V_{T1}$ and second transfer voltage $V_{T2}$ may also be reversed. However, in a mode that reverses the relationship, it may be desirable to reverse the polarity of the first transfer voltage $V_{T1}$ and the second transfer voltage $V_{T2}$.

Also, in this example, the low-resistance recording medium S may be a medium having a predetermined resistance value or less, including a medium having a conductive layer along the medium substrate face. Herein, the latter is described separately because there exist media in which, even though the resistance value itself measured according to a sheet resistance measurement method conforming to JIS standards may not go below a threshold level, the medium may act substantially like a low-resistance medium when a high voltage like the transfer voltage is applied.

Next, representative or exemplary modes of an image forming device according to the present exemplary embodiment will be described.

First, as a representative mode of discriminating the type of the recording medium S, a mode may further include a discriminator 6 that discriminates a type of the recording medium S running towards the transfer region TR, wherein whether or not to activate the second transfer power source 5*b* is decided on a basis of a discrimination signal of the discriminator 6.

Herein, the discriminator 6 may be a detector that detects the sheet resistance of the running recording medium S, and also includes a discriminator that discriminates a signal selecting the type of recording medium S according to a user specification or an automatic selector, for example.

Also, an exemplary mode of the guide member 4 may include a first guide member 4*a* provided grounded at a site distanced from the transfer region TR, and a second guide member 4*b* provided between the first guide member 4*a* and the transfer region TR, and provided grounded via a higher resistance 4*c* than the first guide member 4*a*. In this example, even in the case of using a recording medium S that is not low-resistance, for example, since the second guide member 4*b* disposed close to the transfer region TR is ground via a high resistance, compared to a mode in which the second guide member 4*b* is grounded directly, the leakage of transfer current from the second guide member 4*b* is less likely, which is desirable.

Additionally, in an exemplary mode of the guide member 4, the second guide member 4*b* may be disposed at a position that guides the insertion attitude of the recording medium S to the transfer region TR, and the first guide member 4*a* may be disposed at a different inclination and attitude from the second guide member 4*b*. According to this example, there is an increased degree of freedom in choosing the transport path of the recording medium S, which is desirable.

Also, in an exemplary mode of the transfer power source 5, the transfer voltage $V_{T2}$ of the second transfer power source 5*b* may be chosen at a level at which current does not flow along a path leading to the high-resistance ground of the second guide member 4*b* through the recording medium S.

Additionally, an exemplary mode of the transfer power source 5 includes a toggle switch 7 that selectively toggles the second transfer power source 5*b* with respect to the first transfer power source 5*a*, and the toggle switch 7 is toggled by a control device 8 on the basis of the discrimination signal of the discriminator 6, for example.

Additionally, an exemplary mode of the transfer power source 5 includes a cleaning power source (not illustrated in FIG. 1) that imparts a predetermined cleaning voltage across the paired transfer members 3 (3*a* and 3*b*) when transfer is not being performed, causing a cleaning electric field to act to transfer an image remaining on the transfer member 3*a* positioned opposite the image-carrying face of the image carrier 1 to the image carrier 1 side, in which the cleaning power source is selectively toggled through a toggle switch (not illustrated in FIG. 1) when transfer is not being performed. Herein, the cleaning power source may be provided separately from the second transfer power source 5*b*, or may double as the second transfer power source 5*b*.

Exemplary Embodiment 1

Hereinafter, the present invention will be described in detail on the basis of the exemplary embodiments illustrated in the accompanying drawings.

Figure 2:
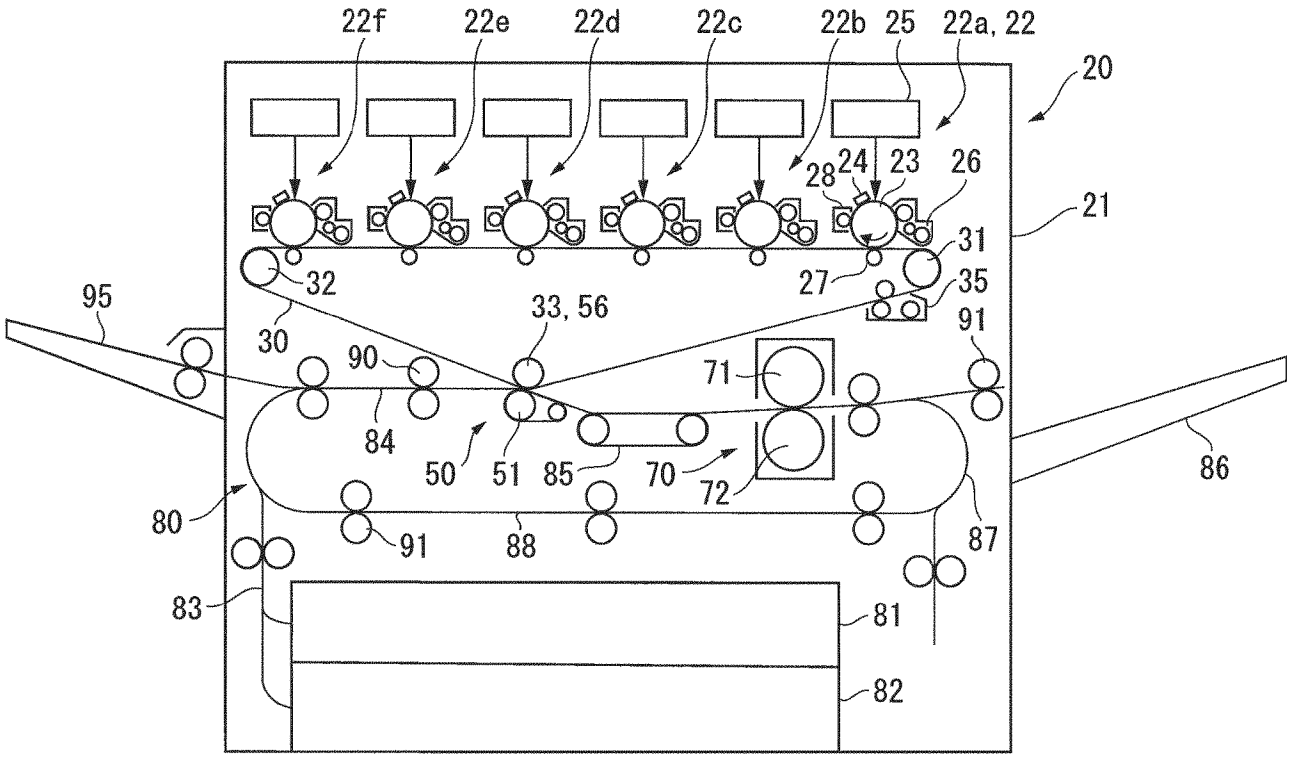
FIG. 2 is an explanatory diagram illustrating an overall configuration of the image forming device according to Exemplary Embodiment 1.

FIG. 2 illustrates an overall configuration of the image forming device according to Exemplary Embodiment 1.

Overall Configuration of Image Forming Device

In the drawing, an image forming device 20 is provided with image forming units 22 (specifically, 22*a* to 22*f*) that form images of multiple color components (in the present exemplary embodiment, White #1, Yellow, Magenta, Cyan, Black, and White #2), a belt-shaped intermediate transfer body 30 that successively transfers (a first transfer) and holds each color component image formed by each image forming unit 22, a secondary transfer device (lump transfer device) 50 that performs a secondary transfer (lump transfer) of each color component image transferred on the intermediate transfer body 30 onto a paper sheet S that acts as a recording medium, a fusing device 70 that fuses the secondarily transferred image onto the paper sheet S, and a paper transport system 80 that transports the paper sheet S to a secondary transfer region. The above components are provided inside an image forming device housing 21. Note that in this example, a white color material of the same color is used for White #1 and White #2, but obviously different white color materials may also be used depending on whether the color material is positioned in a higher or lower layer than another color component image on the paper sheet S. In addition, a transparent color material may also be used instead of one of the white colors, such as White #1, for example.

Image Forming Units

In the present exemplary embodiment, each image forming unit 22 (22*a* to 22*f*) includes a drum-shaped photoreceptor 23. Around the periphery of each photoreceptor 23, there are disposed a charging device 24 such as a corotron or a transfer roller that charges the photoreceptor 23, an exposure device 25 such as a laser scanning device that writes an electrostatic latent image onto the charged photoreceptor 23, a development device 26 that develops the electrostatic latent image written onto the photoreceptor 23 with toner of each color component, a first transfer device 27 such as a transfer roller that transfers the toner image on the photoreceptor 23 onto the intermediate transfer body 30, and a photoreceptor cleaning device 28 that removes residual toner on the photoreceptor 23.

Also, the intermediate transfer body 30 spans across multiple (in the present exemplary embodiment, three) tension rollers 31 to 33. For example, the tension roller 31 is used as a drive roller that is driven by a driving motor (not illustrated), and the intermediate transfer body 30 is made to move in a cyclical manner by the drive roller. Furthermore, an intermediate transfer body cleaning device 35 for removing residual toner on the intermediate transfer body 30 after the secondary transfer is provided between the tension rollers 31 and 33.

Secondary Transfer Device (Lump Transfer Device)

Figure 3:
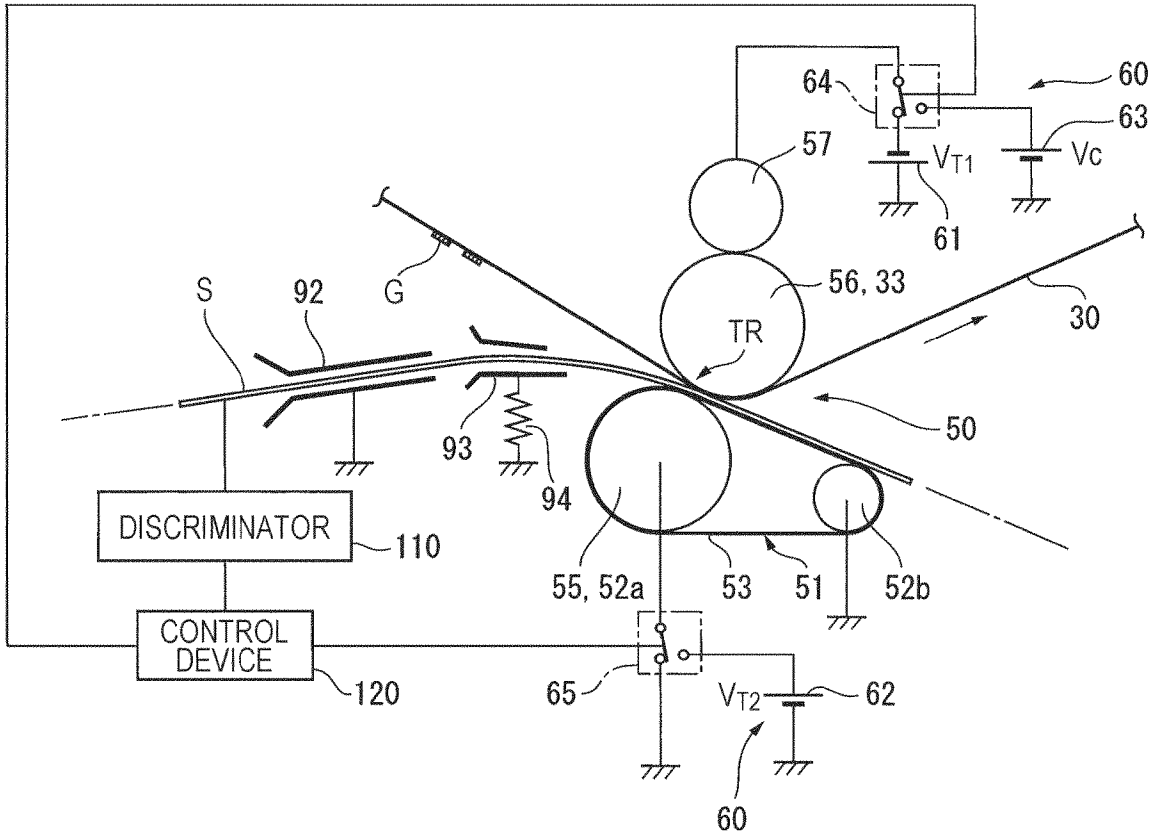
FIG. 3 is an explanatory diagram illustrating details of a configuration around a secondary transfer unit of the image forming device illustrated in FIG. 2.

Additionally, as illustrated in FIGS. 2 and 3, the secondary transfer device (lump transfer device) 50 is disposed so that a belt transfer module 51, in which a transfer transport belt 53 is stretched across multiple (for example, two) tension rollers 52 (specifically, 52*a* and 52*b*), contacts the surface of the intermediate transfer body 30.

Herein, the transfer transport belt 53 is a semiconducting belt with a volume resistivity from $10^6$ to $10^{12}$ Ωcm using a material such as chloroprene. One tension roller 52*a* is configured as an elastic transfer roller 55, and this elastic transfer roller 55 is disposed pressed against the intermediate transfer body 30 through the transfer transport belt 53 in the secondary transfer region (lump transfer region). In addition, the tension roller 33 of the intermediate transfer body 30 is disposed opposite as an opposing roller 56 that forms an opposing electrode with respect to the elastic transfer roller 55, thereby forming a transport path for the paper sheet S proceeding from the position of the one tension roller 52*a* towards the position of the other tension roller 52*b*.

Additionally, in this example, the elastic transfer roller 55 is configured so that the circumference of a metal shaft is covered by an elastic layer in which carbon block or the like has been blended into urethane foam rubber or EPDM.

Note that in this example, the tension rollers 52 (52*a*, 52*b*) of the belt transfer module 51 are both grounded, thereby discouraging the accumulation of charge in the transfer transport belt 53. Also, if the peelability of the paper sheet S at the downstream end of the transfer transport belt 53 is taken into consideration, it is effective to make the diameter of the tension roller 52*b* on the downstream side smaller than the tension roller 52*a* on the upstream side.

<Transfer Power Source>

Furthermore, in this example, as illustrated in FIG. 3, a transfer power source 60 is provided with a normal transfer power source 61 acting as a first transfer power source that applies a first transfer voltage $V_{T1}$ used normally to the opposing roller 56 (in this example, the roller also doubles as the tension roller 33) via a power supply roller 57, an assisted transfer power source 62 acting as a second transfer power source that applies a second transfer voltage $V_{T2}$, which is of the opposite polarity of the first transfer voltage $V_{T1}$ and whose absolute value is less than or equal to the first transfer voltage $V_{T1}$, to the elastic transfer roller 55 (the first tension roller 52*a*) of the belt transfer module 51, and a cleaning power source 63 that applies a cleaning voltage Vc of the opposite polarity of the first transfer voltage $V_{T1}$ to the opposing roller 56 via the power supply roller 57 during a cleaning cycle when transfer is not being performed.

Figure 5:
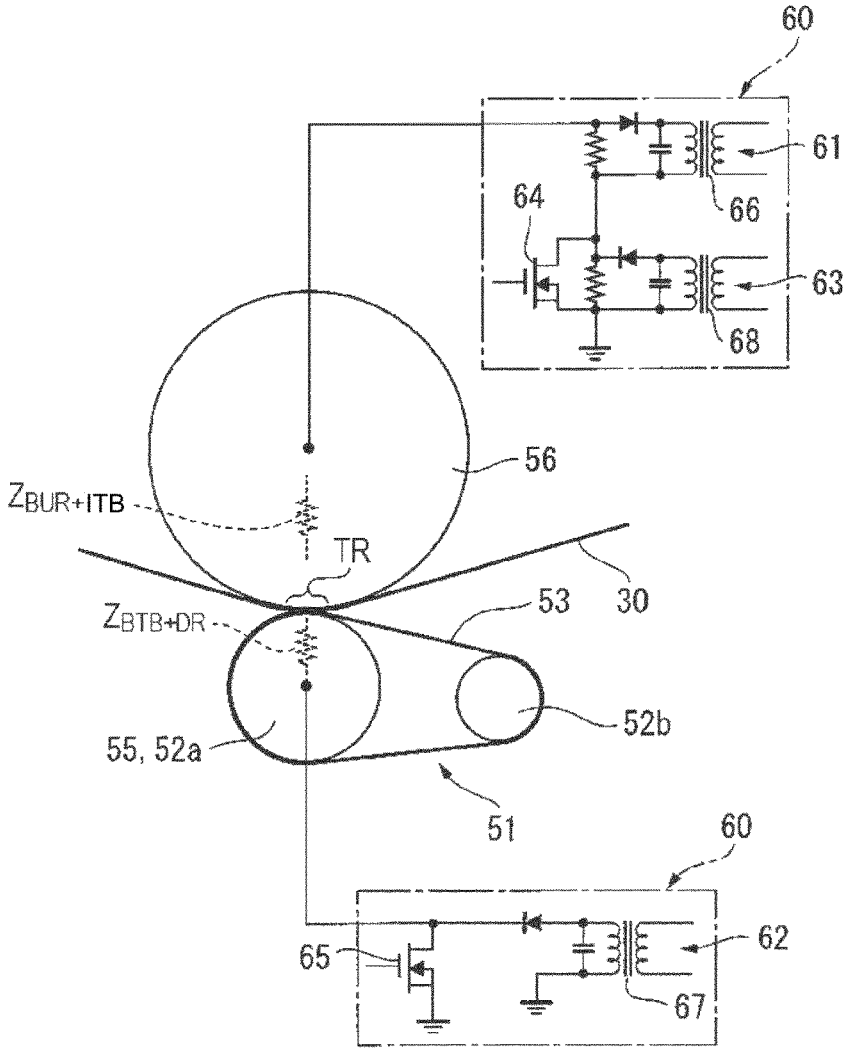
FIG. 5 is an explanatory diagram illustrating an exemplary configuration of a transfer power source of the secondary transfer unit used in Exemplary Embodiment 1.

Additionally, in this example, as illustrated in FIG. 5, the normal transfer power source 61, the assisted transfer power source 62, and the cleaning power source 63 are configured to utilize transformers 66 to 68 capable of outputting high voltages, for example. Note that in FIG. 5, the power supply roller 57 illustrated in FIG. 3 has been omitted.

Furthermore, in this example, a first toggle switch 64 that selectively toggles between the normal transfer power source 61 and the cleaning power source 63 is provided, while in addition, a second toggle switch 65 that selectively toggles between the assisted transfer power source 62 and ground is provided.

Additionally, in this example, the transfer power source 60 is configured so that only the normal transfer power source 61 is used under conditions in which the paper sheet S is not low-resistance, and so that both the normal transfer power source 61 and the assisted transfer power source 62 are used under conditions in which the paper sheet S is low-resistance, thereby forming a designated transfer electric field in the transfer region TR between the elastic transfer roller 55 and the opposing roller 56.

Also, the cleaning cycle is configured to be performed at an appropriate timing when transfer is not being performed. For example, the cleaning cycle is performed at a predetermined timing such as when the image forming device is powered on, or when the imaging cycle ends.

Fusing Device

As illustrated in FIG. 2, the fusing device 70 includes a drivably rotatable heat-fusing roller 71 disposed to contact the face on the image-holding side of the paper sheet S, and a pressure-fusing roller 72 which is disposed to press against the heat-fusing roller 71, and which rotates to track the heat-fusing roller 71. The fusing device 70 causes the image held on the paper sheet S to pass through the transfer region between the fusing rollers 71 and 72, and fuses the image by applying heat and pressure.

Paper Transport System

Furthermore, as illustrated in FIGS. 2 and 3, the paper transport system 80 includes multiple (in this example, two stages) paper supply containers 81 and 82. The paper sheet S supplied from either of the paper supply containers 81 and 82 is transported from a vertical transport path 83 extending in an approximately vertical direction through a horizontal transport path 84 extending in an approximately horizontal direction to reach the secondary transfer region TR. After that, the paper sheet S holding a transferred image is transported via a transport belt 85 to the site of fusing by the fusing device 70, and is delivered into a paper delivery receptacle 86 provided on a side face of the image forming device housing 21.

In addition, the paper transport system 80 includes a reversing branch transport path 87 that branches downward from the portion on the downstream side of the fusing device 70 in the paper transport direction as part of the horizontal transport path 84. A paper sheet S reversed by the branch transport path 87 again returns to the horizontal transport path 84 from the vertical transport path 83 via a return transport path 88, and an image is transferred onto the back face of the paper sheet S at the secondary transfer region TR. The paper sheet S then passes through the fusing device 70 and is delivered into the paper delivery receptacle 86.

Also, the paper transport system 80 is provided with registration rollers 90 that align and supply the paper sheet S to the secondary transfer region TR, as well as an appropriate number of transport rollers 91 in each of the transport paths 83, 84, 87, and 88. Additionally, on the entrance side of the secondary transfer region TR of the horizontal transport path 84, multiple (in this example, two) guide chutes 92 and 93 that guide the paper sheet S passing through the registration rollers 90 to the secondary transfer region TR are provided. In this example, the guide chute 92 positioned earlier guides the paper sheet S that has passed through the registration rollers 90 to the guide chute 93 positioned later, while the later chute 93 guides the paper sheet S towards the secondary transfer region TR. The earlier guide chute 92 and the later guide chute 93 are disposed at mutually different inclinations and attitudes. Additionally, the earlier guide chute 92 is grounded directly, while the later guide chute 93 is grounded via a high resistance 94. Moreover, on the side of the image forming device housing 21 opposite from the paper delivery receptacle 86, a manual feed paper supplier 95 enabling the manual feeding of paper into the horizontal transport path 84 is provided.

Paper Types

Examples of the paper sheet S which are usable in this example obviously include plain paper having a sheet resistance from $10^{10}$ to $10^{12}$ Ω/□, for example, as well as low-resistance paper having a lower sheet resistance than plain paper.

Figure 4A:
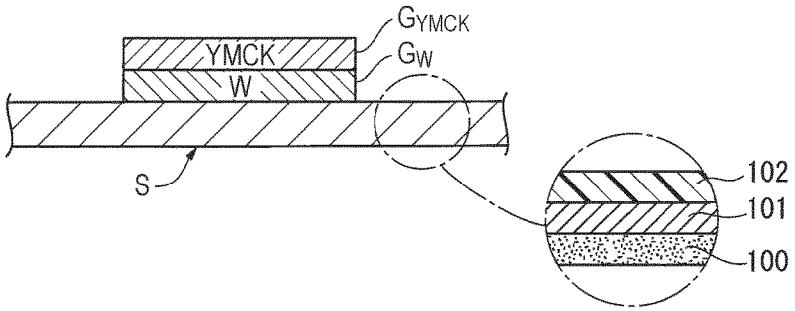
FIG. 4A is an explanatory diagram illustrating an Imaging Example 1 of forming an image onto low-resistance paper by the image forming device according to Exemplary Embodiment 1.

Herein, as illustrated in FIG. 4A, for example, a typical mode of the low-resistance paper sheet S is that which is designated so-called metallic paper, in which a metal layer 101 such as aluminum is laminated onto a substrate layer 100 made of a paper substrate, and in addition, the metal layer 101 is covered by a surface layer 102 made of a plastic such as PET. Note that an adhesive layer made of PET or the like may also be provided between the substrate layer 100 and the metal layer 101.

Some metallic papers of this type have a predetermined resistance value or less, but for example, for metallic paper provided with a surface layer 102 of a high-resistance material, even though the resistance value itself measured according to a sheet resistance measurement method conforming to JIS standards may not go below a threshold level, the metallic paper may act substantially like low-resistance paper when the transfer voltage $V_{TR}$ is applied.

Figure 4B:
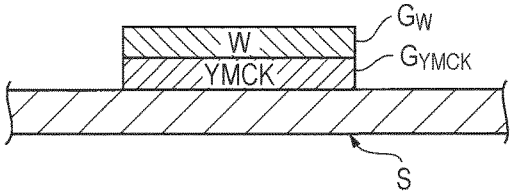
FIG. 4B is an explanatory diagram illustrating a similar Imaging Example 2.

On metallic paper acting as the low-resistance paper sheet S of this type, it is possible to form directly a color image made of YMCK (Yellow, Magenta, Cyan, Black), for example. However, as illustrated in FIG. 4A, for example, the image forming unit 22*f* illustrated in FIG. 2 for example may be used to form a white image $G_W$ as a background image made of white W on top of metallic paper, while in addition, the image forming units 22*b* to 22*e* illustrated in FIG. 2 for example may be used to form a color image $G_{YMCK}$ made of YMCK on top of the white image $G_W$. Alternatively, as illustrated in FIG. 4B, the image forming units 22*b* to 22*e* illustrated in FIG. 2 for example may be used to form the color image $G_{YMCK}$ made of YMCK on top of the metallic paper, while in addition, the image forming unit 22*a* illustrated in FIG. 2 may be used to form the white image $G_W$ made of white W on top of the color image $G_{YMCK}$.

Exemplary Configuration of Discriminator

Figure 4C:
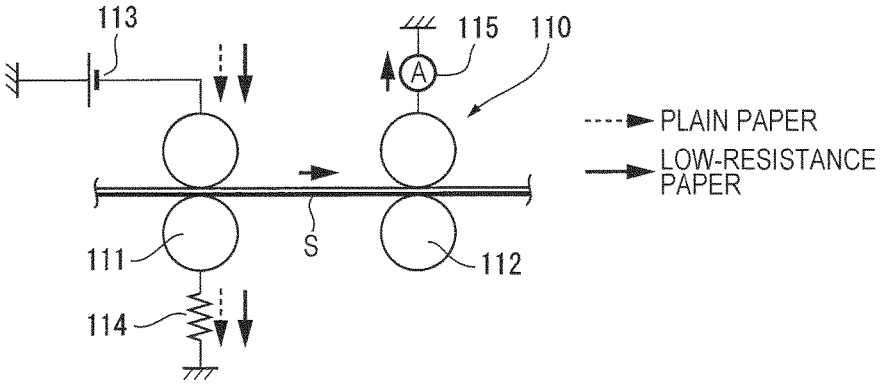
FIG. 4C is an explanatory diagram illustrating an example of the discriminator illustrated in FIG. 3.

In this example, as illustrated in FIG. 3, a discriminator 110 for discriminating the paper type is provided in a part of the vertical transport path 83 or the horizontal transport path 84 of the paper transport system 80. As illustrated in FIG. 4C, for example, in the discriminator 110, paired discrimination rollers 111 and 112 are arranged in parallel along the transport direction of the paper sheet S. With respect to the pair of discrimination rollers 111 positioned on the upstream side in the transport direction of the paper sheet S, a discrimination power source 113 is connected to one roller, while the other roller is grounded via a resistor 114. With respect to the other pair of discrimination rollers 112 positioned on the downstream side in the transport direction of the paper sheet S, a current meter 115 is provided between one roller and ground. Note that the members for transporting the paper sheet S (the registration rollers 90 and the transport rollers 91) may also double as the discrimination rollers 111 and 112, or may be provided separately from the transport members.

In this example, assuming that plain paper is used as the paper sheet S, for example, since the sheet resistance of plain paper is large to a certain extent, even if a plain paper sheet is disposed stretched between the pairs of discrimination rollers 111 and 112, as indicated by the dashed arrow in FIG. 4C, the discrimination current from the discrimination power source 113 flows cutting across the pair of discrimination rollers 111, and little to no current goes through the paper sheet S to reach the current meter 115 on the discrimination rollers 112 side.

In contrast, assuming that low-resistance paper such as metallic paper is used as the paper sheet S, since the sheet resistance of the low-resistance paper is small compared to plain paper, in the case in which a sheet of low-resistance paper is disposed stretched between the pairs of discrimination rollers 111 and 112, as indicated by the solid arrows in FIG. 4C, part of the discrimination current from the discrimination power source 113 flows cutting across the pair of discrimination rollers 111, and in addition, the rest of the discrimination current goes through the paper sheet S to reach the current meter 115 on the discrimination rollers 112 side. With the measured current measured by the current meter 115 and the applied voltage of the discrimination power source 113, the sheet resistance of the paper sheet S is computed, and the paper type is discriminated.

Note that this example is a mode in which the paper type is discriminated by having the discriminator 110 measure the sheet resistance of the paper sheet S during transport, but the paper type may also be discriminated on the basis of a specification signal when the paper type used by the user has been specified, for example.

Drive Control System of Image Forming Device

In the present exemplary embodiment, as illustrated in FIG. 3, the sign 120 denotes a control device that controls an imaging process of the image forming device. The control device 120 is made up of a microcomputer including a CPU, ROM, RAM, and an input/output interface. Through the input/output interface, various input signals are acquired, such as a switch signal from a start switch, a mode selection switch for selecting the imaging mode, and the like (not illustrated), various sensor signals, as well as a paper discrimination signal from the discriminator 110 that discriminates the paper type. An imaging control program (see FIG. 6) stored in advance in the ROM is executed by the CPU, and after generating control signals for the targets of drive control, the control signals are sent out to each target of drive control.

Operation of Image Forming Device

Figure 6:
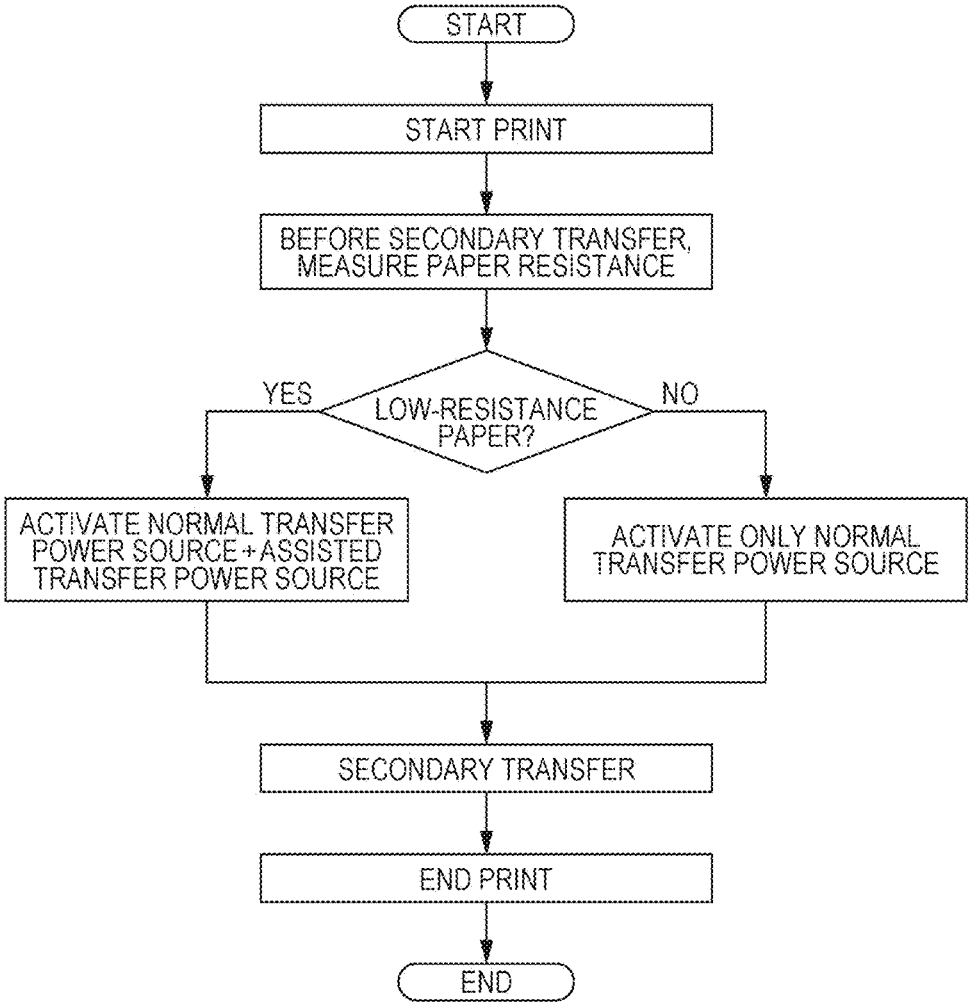
FIG. 6 is a flowchart illustrating a low-resistance paper imaging sequence used in the image forming device according to Exemplary Embodiment 1.

Now, in the image forming device illustrated in FIG. 2, supposing a case in which paper sheets S with different sheet resistance are mixed together and used, as illustrated in FIG. 6, by turning on the start switch (not illustrated), printing (an imaging process) by the image forming device is started.

At this time, the paper sheet S is supplied from one of the paper supply containers 81 and 82 or the manual feed paper supplier 95, and transported along a designated transport path towards the secondary transfer region TR. While the paper sheet S is being transported, before reaching the secondary transfer region TR, measurement of the sheet resistance of the paper sheet S by the discriminator 110 (the paper type discrimination process) is performed.

The control device 120 determines whether or not the paper sheet S is low-resistance paper on the basis of the discrimination result of the discriminator 110, and in the case of low-resistance paper, the control device 120 switches the first toggle switch 64 to the normal transfer power source 61, and additionally switches the second toggle switch 65 to the assisted transfer power source 62.

On the other hand, if the control device 120 determines that the paper sheet S is not low-resistance paper, the control device 120 switches the first toggle switch 64 to the normal transfer power source 61, and switches the second toggle switch 65 directly to ground.

After that, when the paper sheet S reaches the secondary transfer region TR, an image G transferred formed by each of the image forming units 22 (22*a* to 22*f*) and transferred onto the intermediate transfer body 30 by the first transfer is then transferred onto the paper sheet S by the secondary transfer, and after going through the fusing process by the fusing device 70, the paper sheet S is delivered in the paper delivery receptacle 86, and the series of printing operating (imaging process) ends.

Secondary Transfer Operation Sequence

<Plain Paper>

Figure 7B:
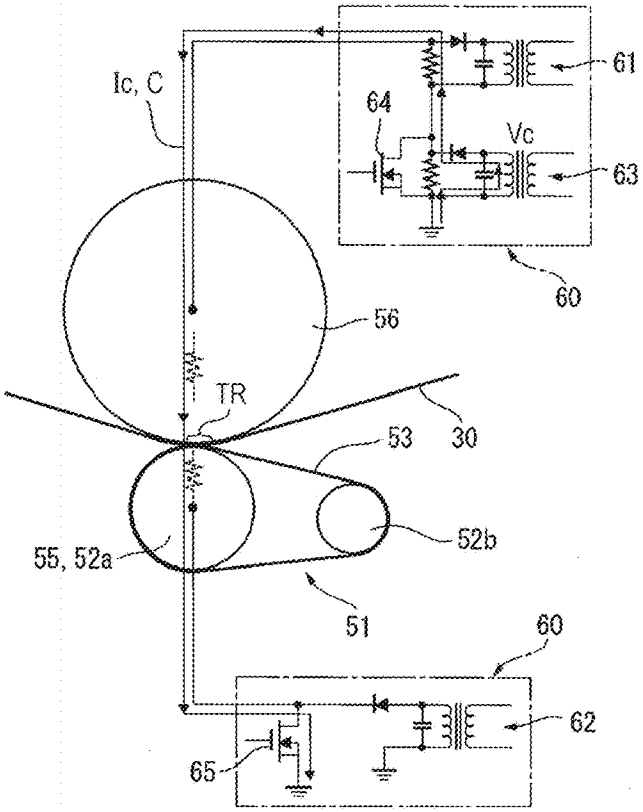
FIG. 7B is an explanatory diagram illustrating an operational example during cleaning of the same transfer power source.
Figure 7A:
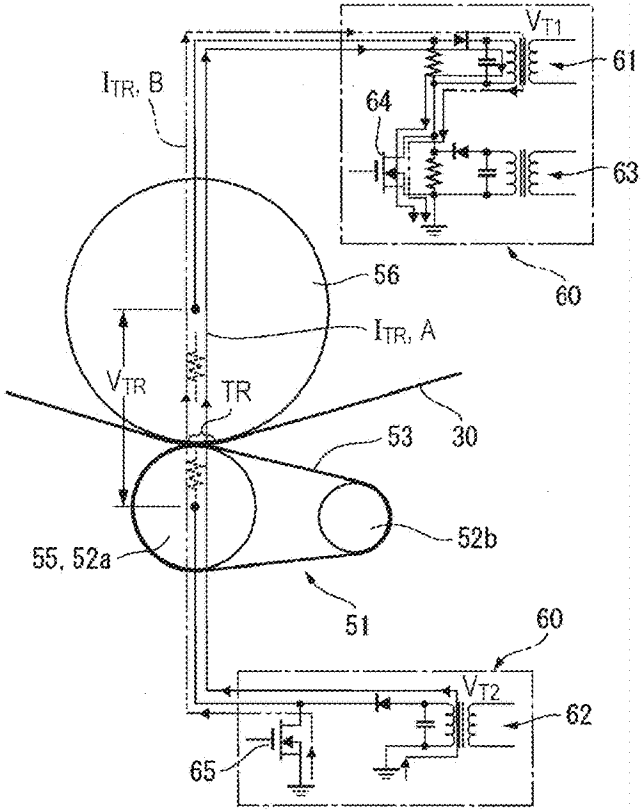
FIG. 7A is an explanatory diagram illustrating an operational example during transfer by the transfer power source of the secondary transfer unit used in Exemplary Embodiment 1.

Now, in the case in which the paper sheet S is plain paper, as illustrated in FIGS. 3, 5, and 7A, only the normal transfer power source 61 is activated as the transfer power source 60, a transfer voltage $V_{TR}$ made up of the transfer voltage $V_{T1}$ from the normal transfer power source 61 is applied in the secondary transfer region TR, and as indicated by the chain line B in FIG. 7A, a transfer current $I_{TR}$ flows.

In this state, the paper sheet S reaches the secondary transfer region TR via the guide chutes 92 and 93, and in the secondary transfer region TR, the image G on the intermediate transfer body 30 is transferred to the paper sheet S by the secondary transfer. At this time, while the paper sheet S is passing through the secondary transfer region TR, even if the paper sheet S has been contacting the guide chutes 92 and 93, since the sheet resistance of the paper sheet S is high to a certain extent, part of the transfer current $I_{TR}$ in the secondary transfer region TR does not leak out through a conductive path leading to the ground of the guide chutes 92 and 93 with the paper sheet S acting as a conductive path. Instead, the transfer operation with respect to the paper sheet S in the secondary transfer region TR is performed stably, and trouble such as lowered image density in part of the paper sheet S does not occur.

<Low-Resistance Paper>

Next, the case in which the paper sheet S is low-resistance paper (for example, metallic paper) will be described.

In this case, as illustrated in FIGS. 3, 5 and 7A, the normal transfer power source 61 and the assisted transfer power source 62 are activated as the transfer power source 60, a transfer voltage $V_{TR}$ made up of the sum of the transfer voltage $V_{T1}$ from the normal transfer power source 61 and the transfer voltage $V_{T2}$ from the assisted transfer power source 62 is applied in the secondary transfer region TR, and as indicated by the solid line A in FIG. 7A, a transfer current $I_{TR}$ flows.

In this state, since the transfer voltage $V_{T2}$ of positive polarity is being applied by the assisted transfer power source 62 to the elastic transfer roller 55 of the belt transfer module 51, the elastic transfer roller 55 is kept at a higher electric potential than the ground potential of the guide chutes 92 and 93, for example.

Figure 8A:
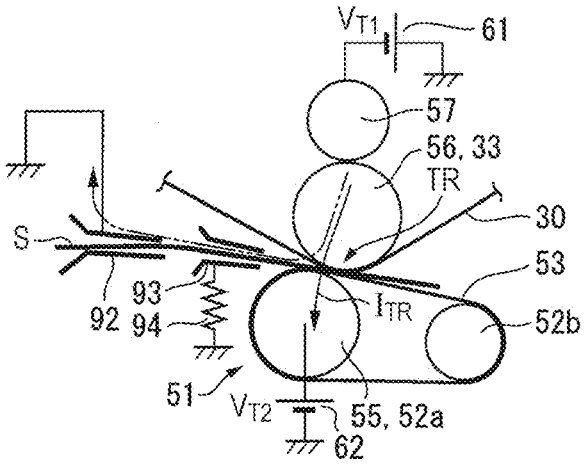

Now, assuming that the trailing end of the low-resistance paper sheet S has not yet passed through the earlier guide chute 92, as illustrated in FIG. 8A, the low-resistance paper sheet S is disposed stretched between the secondary transfer region TR and the earlier guide chute 92. At this time, since the elastic transfer roller 55 of the secondary transfer region TR is kept at an electric potential higher than the ground potential of the earlier guide chute 92 by the transfer voltage $V_{T2}$, the transfer current $I_{TR}$ flowing through the secondary transfer region TR continuously flows through the conductive path indicated by the solid line A in FIG. 7A, and there is little to no risk of leakage current flowing along a conductive path leading from the earlier guide chute 92 to ground with the low-resistance paper sheet S acting as a conductive path. For this reason, in the secondary transfer region TR, a transfer electric field pointing towards the low-resistance paper sheet S acts on the image G on the intermediate transfer body 30, and stable secondary transfer operations are performed.

Figure 8B:
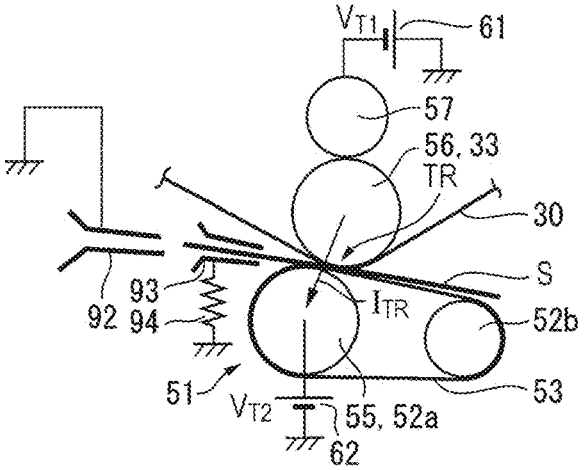

Subsequently, when the low-resistance paper sheet S passes through the earlier guide chute 92, as illustrated in FIG. 8B, the trailing end of the low-resistance paper sheet S passes through while contacting the later guide chute 93, thereby causing the low-resistance paper sheet S to be disposed stretched between the secondary transfer region TR and the later guide chute 93.

At this time, since the later guide chute 93 is grounded via the high resistance 94, unlike the earlier guide chute 92, the resistance condition between the guide chutes 92 and 93 contacted by the low-resistance paper sheet S changes. Since the elastic transfer roller 55 of the secondary transfer region TR is being kept at an electric potential higher than the ground potential of the later guide chute 93 by the transfer voltage $V_{T2}$, there is little to no risk of leakage current flowing along a conductive path leading from the later guide chute 93 to ground with the low-resistance paper sheet S acting as a conductive path, and in the secondary transfer region TR, stable secondary transfer operations are performed continuously.

Figure 10A:
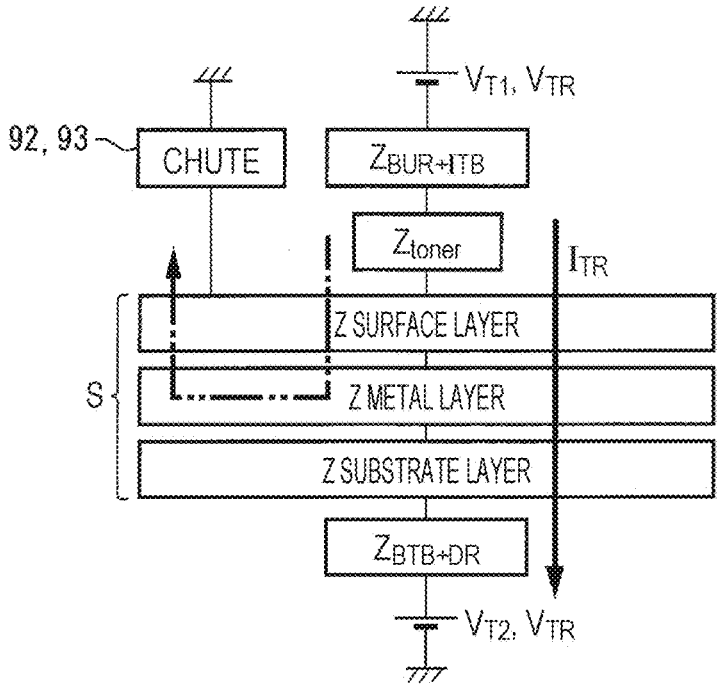
FIG. 10A is an explanatory diagram schematically illustrating the flow of a transfer current of a transfer operation sequence with respect to low-resistance paper by the image forming device according to Exemplary Embodiment 1.

Herein, the impedance of each element around the secondary transfer region TR of the present exemplary embodiment is defined as follows, and FIG. 10A schematically illustrates an equivalent circuit.

$Z_{BUR+ITB}$: impedance of opposing roller 56+intermediate transfer body 30

$Z_{BTB+DR}$: impedance of belt transfer module 51 (transfer transport belt 53+elastic transfer roller 55)

$Z_{ITB}$: impedance of intermediate transfer body 30

$Z_{toner}$: impedance of toner

Z substrate layer: impedance of substrate layer 100 of low-resistance paper sheet S Z metal layer: impedance of metal layer 101 of low-resistance paper sheet S Z surface layer: impedance of surface layer 102 of low-resistance paper sheet S Note that in FIG. 10A, the sign 92 (93) indicates the guide chute, $V_{TR}$ indicates the transfer voltage, and $I_{TR}$ indicates the transfer current.

In the equivalent circuit illustrated in the drawing, when the transfer voltage $V_{TR}$ ($V_{T1}+V_{T2}$) is applied to the secondary transfer region TR, the transfer current $I_{TR}$ flows between the belt transfer module 51 and the opposing roller 56. At this time, the impedance of the metal layer 101 of the low-resistance paper sheet S is low, but since the elastic transfer roller 55 of the belt transfer module 51 is kept at an electric potential higher than the ground potential of the guide chute 92 (93) by the transfer voltage $V_{T2}$, as indicated by the chain line in FIG. 10A, there is little to no risk that part of the transfer current $I_{TR}$ will flow to the guide chute 92 (93) side with the metal layer 101 of the low-resistance paper sheet S acting as a conductive path. Instead, as indicated by the solid line in FIG. 10A, the transfer current $I_{TR}$ flows through the secondary transfer region TR between the belt transfer module 51 and the opposing roller 56. Herein, as illustrated in FIG. 7A, the transfer current $I_{TR}$ is determined by the transfer voltage $V_{TR}$ ($V_{T1}+V_{T2}$) and the impedances of the opposing roller 56, the intermediate transfer body 30, and the belt transfer module 51 ($Z_{BUR+ITB}$, $Z_{BTB+DR}$).

For this reason, even if the low-resistance paper sheet S is disposed stretched between the secondary transfer region TR and the guide chute 92 (93), there is little to no risk of a part of the transfer current $I_{TR}$ leaking via the low-resistance paper sheet S and the guide chute 92 (93), and the transfer current $I_{TR}$ flowing through the secondary transfer region TR is kept in a stable state. Thus, for example, even if a halftone image of uniform density is printed over approximately the entire area of the low-resistance paper sheet S, a density step in the transfer image caused by fluctuations of the transfer current $I_{TR}$ in the secondary transfer region TR is suppressed.

Figure 8C:
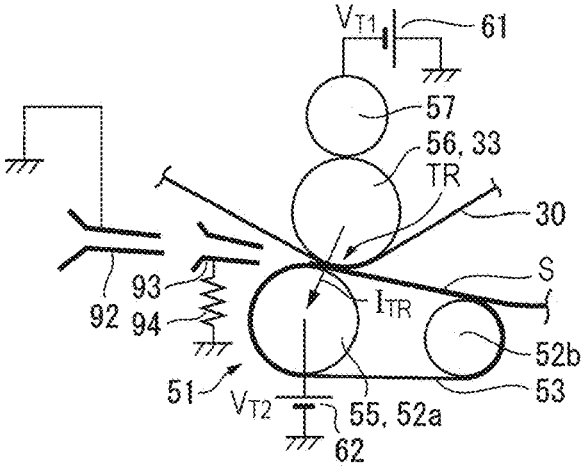

After that, in the case in which the trailing end of the low-resistance paper sheet S exits the later guide chute 93 and passes through the secondary transfer region TR, as illustrated in FIG. 8C, the low-resistance paper sheet S changes from a state of being disposed stretched between the secondary transfer region TR and the later guide chute 93 to a state of separating from the later guide chute 93 and passing through the secondary transfer region TR. However, since the transfer current $I_{TR}$ flowing through the secondary transfer region TR does not change, stable secondary transfer operations are performed in the secondary transfer region TR.

For this reason, in the present exemplary embodiment, even if a halftone image of uniform density is printed over approximately the entire area of the low-resistance paper sheet S, there is little to no risk of a density step occurring in the transfer image G on the trailing end of the low-resistance paper sheet S.

Comparative Embodiment 1

Next, after evaluating the performance due to the configuration around the secondary transfer region TR according to the present exemplary embodiment, the performance due to a configuration around the secondary transfer region TR according to Comparative Embodiment 1 will be described.

Figure 9A:
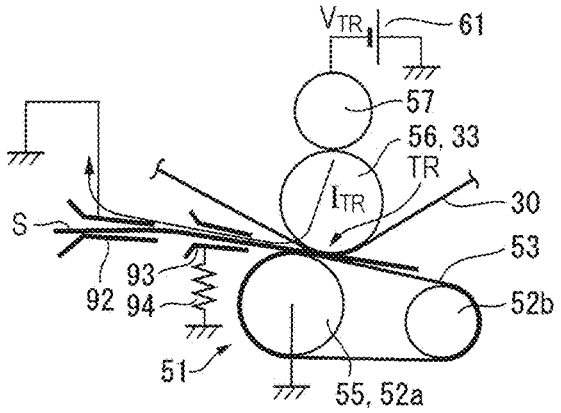
FIG. 9A Related Art

As illustrated in FIG. 9A, the basic configuration around the secondary transfer region TR according to Comparative Embodiment 1 is approximately similar to Exemplary Embodiment 1, but unlike Exemplary Embodiment 1, even in the case of using a low-resistance paper sheet S such as metallic paper, only the normal transfer power source 61 is used as the transfer power source 60, without using the assisted transfer power source 62. Note that the structural elements similar to Exemplary Embodiment 1 are denoted with similar signs as Exemplary Embodiment 1, and detailed description thereof will be omitted.

As illustrated in FIG. 9A, assuming that the trailing end of the low-resistance paper sheet S has not yet passed through the earlier guide chute 92, approximately similar to Exemplary Embodiment 1, the low-resistance paper sheet S is disposed stretched between the secondary transfer region TR and the earlier guide chute 92.

At this time, since the elastic transfer roller 55 of the belt transfer module 51 in the secondary transfer region TR is not directly grounded, the surface potential of the belt transfer module 51 of the secondary transfer region TR is not only of equal potential to the ground potential of the earlier guide chute 92, but as described later, the impedance of the belt transfer module 51 is high compared to the impedance leading to the ground of the earlier guide chute 92. For this reason, if the transfer voltage $V_{TR}$ from the normal transfer power source 61 acting as the transfer power source 60 is applied to the opposing roller 56, in the secondary transfer region TR, the transfer current $I_{TR}$ from the normal transfer power source 61 becomes leakage current leading from the earlier guide chute 92 to ground with the low-resistance paper sheet S acting as a conductive path, but since the transfer current $I_{TR}$ stably flows from the opposing roller 56 to the low-resistance paper sheet S side via the intermediate transfer body 30, stable secondary transfer operations are performed in the secondary transfer region TR.

Figure 9B:
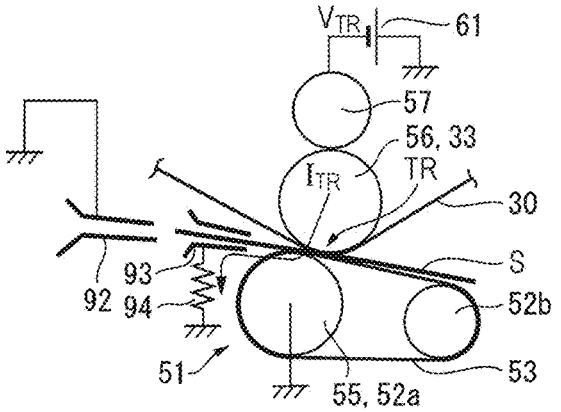
FIG. 9B Related Art

Subsequently, when the low-resistance paper sheet S passes through the earlier guide chute 92, as illustrated in FIG. 9B, the trailing end of the low-resistance paper sheet S passes through while contacting the later guide chute 93, thereby causing the low-resistance paper sheet S to be disposed stretched between the secondary transfer region TR and the later guide chute 93.

At this time, since the later guide chute 93 is grounded via the high resistance 94, unlike the earlier guide chute 92, the resistance condition between the guide chutes 92 and 93 contacted by the low-resistance paper sheet S changes, and because there is a disparity in the resistance conditions of the guide chutes 92 and 93, there is a risk that the transfer current $I_{TR}$ may change in the secondary transfer region TR.

Figure 10B:
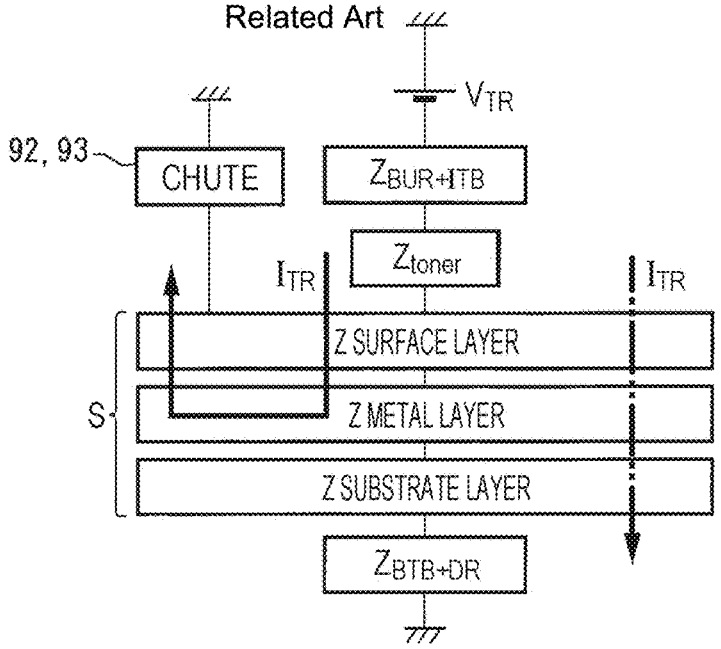
FIG. 10B Related Art
FIG. 10B is an explanatory diagram schematically illustrating the flow of a transfer current of a transfer operation sequence with respect to low-resistance paper by the image forming device according to Comparative Example 1.

Herein, FIG. 10B illustrates an equivalent circuit of each element around the secondary transfer region TR in Comparative Embodiment 1. Note that the impedance of each element in the FIG. 10B is denoted similarly to that defined in FIG. 10A.

In the drawing, when the transfer voltage $V_{TR}$ is applied to the secondary transfer region TR, since the surface potential of the belt transfer module 51 is of equal potential to the guide chute 92 (93), for example, in the case in which the impedance of the belt transfer module 51 is higher than the impedance of the later guide chute 93 due to the high resistance 94, in the secondary transfer region TR, as indicated by the solid line in FIG. 10B, the transfer current $I_{TR}$ from the normal transfer power source 61 flows as a leakage current along a conductive path leading from the later guide chute 93 to ground with the low-resistance paper sheet S acting as a conductive path. Also, in the case in which the impedance of the belt transfer module 51 is lower than the impedance of the later guide chute 93 due to the high resistance 94, in the secondary transfer region TR, as indicated by the virtual line in FIG. 10B, the transfer current $I_{TR}$ from the normal transfer power source 61 flows along a conductive path lead from the elastic transfer roller 55 of the belt transfer module 51 to ground. However, in either case, there is a risk that the disparity in the resistance condition between the guide chutes 92 and 93 may cause the transfer current $I_{TR}$ to change in the secondary transfer region TR. For this reason, for example, in the case of printing a halftone image of uniform density over approximately the entire area of the low-resistance paper sheet S, a density step in the transfer image caused by fluctuations of the transfer current $I_{TR}$ in the secondary transfer region TR occurs easily.

Figure 9C:
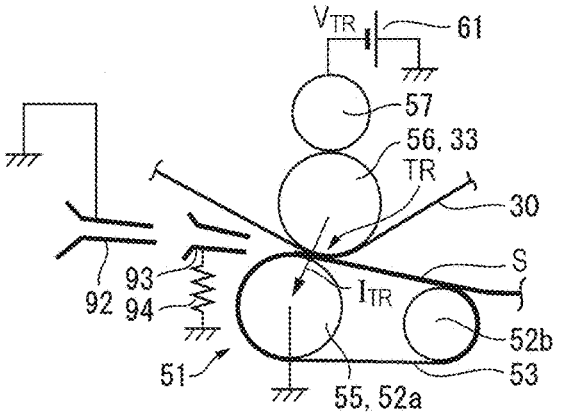
FIG. 9C Related Art

After that, in the case in which the trailing end of the low-resistance paper sheet S passes through the secondary transfer region TR, as illustrated in FIG. 9C, since the trailing end of the low-resistance paper sheet S separates from the later guide chute 93, in the secondary transfer region TR, the transfer current $I_{TR}$ from the normal transfer power source 61 flows along a conductive path leading from the elastic transfer roller 55 of the belt transfer module 51 to ground. At this time, since the difference between the impedance of the belt transfer module 51 and the impedance due to the high resistance 94 leading to the ground of the later guide chute 93 causes the transfer current $I_{TR}$ in the secondary transfer region TR to change, for example, in the case of printing a halftone image of uniform density over approximately the entire area of the low-resistance paper sheet S, a density step in the transfer image caused by fluctuations in the transfer current $I_{TR}$ in the secondary transfer region TR occurs easily near the trailing end of the low-resistance paper sheet S.

Note that in Comparative Embodiment 1, the normal transfer power source 61 applies a transfer voltage $V_{TR}$ of constant voltage, but in the case of adopting a constant current control method, for example, there is a possibility of alleviating the change in the transfer current $I_{TR}$ described above. However, since inflowing current is produced when the low-resistance paper sheet S separates from or makes contact with the later guide chute 93 grounded via a high resistance, the risk of a density step occurring in the transfer image still remains unless the current response of the constant current control method is set sufficiently high.

Cleaning Cycle

Also, in the present exemplary embodiment, the secondary transfer device 50 performs a cleaning cycle at a predetermined timing when transfer is not being performed.

In the present example, during the cleaning cycle, the control device 120 switches the first toggle switch 64 to the cleaning power source 63, while also switching the second toggle switch 65 directly to ground, as illustrated in FIGS. 3 and 5. As a result, as illustrated in FIG. 7B, a cleaning voltage Vc (positive polarity of the inverse polarity of the first transfer voltage $V_{T1}$) from the cleaning power source 63 is applied to the opposing roller 56 via the power supply roller 57, and in the secondary transfer region TR, a cleaning current Ic flows between the elastic transfer roller 55 of the belt transfer module 51. Herein, the cleaning current Ic is determined by the cleaning voltage Vc and the impedances of the opposing roller 56, the intermediate transfer body 30, and the belt transfer module 51 ($Z_{BUR+ITB}$, $Z_{BTB+DR}$).

At this time, since the cleaning voltage Vc of positive polarity is applied to the opposing roller 56, even if toner of negative polarity which is part of the transfer image G has adhered to the transfer transport belt 53 of the belt transfer module 51, the cleaning voltage Vc creates a cleaning electric field capable of drawing the negative-polarity toner from the transfer transport belt 53 to the intermediate transfer body 30, and the negative-polarity toner is drawn and adheres to the intermediate transfer body 30 side. For this reason, the negative-polarity toner drawn and adhering to the intermediate transfer body 30 side is cleaned by the intermediate transfer body cleaning device 35.

WORKING EXAMPLES

Working Example 1

Working Example 1 embodies the image forming device according to Exemplary Embodiment 1, and illustrates the case of using a low-resistance paper sheet S such as metallic paper.

In this working example, as illustrated in FIG. 4C, it is sufficient for the discriminator 110 that discriminates the paper type to monitor the current flowing through the current meter 115 when a discrimination voltage is applied from the discrimination power source 113, and determine the paper to be the low-resistance paper sheet S on the condition that current exceeding a certain threshold value is flowing. For example, in the case of applying 130 μA as a discrimination current by the discrimination power source 113, when the low-resistance paper sheet S such as metallic paper is passed through, close to half the current, specifically 60 μA, is detected as a monitor current of the current meter 115. Assuming that the current is less than 30 μA in the case of plain paper, by choosing 30 μA as the threshold value of the current meter 115, it is possible to discriminate the low-resistance paper sheet S.

Also, if the transfer power source 60 of the secondary transfer device 50 is set as follows, the secondary transfer operations and the cleaning cycle are realizable.

Now, provided that $Z_{BUR+ITB}$ (the impedance of the opposing roller 56+the intermediate transfer body 30) is 30 MΩ, and $Z_{BTB+DR}$ (the impedance of the belt transfer module 51) is 5 MΩ, the first transfer voltage $V_{T1}$ of the normal transfer power source 61 is chosen to be −8.7 kV, the second transfer voltage $V_{T2}$ of the assisted transfer power source 62 is chosen to be +1.3 kV, and the cleaning voltage Vc of the cleaning power source 63 is chosen to be +1.2 kV.

In this example, in the case of using the low-resistance paper sheet S, a transfer voltage $V_{TR}$ ($|V_{T1}+V_{T2}|$=a potential difference of approximately 10 kV) of negative polarity is applied to the secondary transfer region TR, and the transfer current $I_{TR}$ labeled A in FIG. 7A flows stably.

Herein, −8.7 kV is chosen to be the transfer voltage $V_{T1}$ of the normal transfer power source 61, but this is a value close to the upper voltage limit of a high-voltage power source, and generating a larger voltage may involve a large transformer, further increasing power source costs. For this reason, in this example, a method is adopted in which a substantially high-voltage transfer voltage $V_{TR}$ is applied by adding the low-cost assisted transfer power source 62 in addition to the normal transfer power source 61.

Also, in the case of using paper other than the low-resistance paper sheet S, a transfer voltage $V_{TR}$ ($|V_{T1}|$=a potential difference of approximately 8.7 kV) of negative polarity provided by the normal transfer power source 61 only is applied to the secondary transfer region TR, and the transfer current $I_{TR}$ labeled B in FIG. 7A flows stably.

Furthermore, during the cleaning cycle, the cleaning voltage Vc (approximately 1.2 kV) of positive polarity provided by the cleaning power source 63 is applied to the secondary transfer region TR, and the cleaning current Ic labeled C in FIG. 7B flows.

Comparative Example 1

Figure 11A:
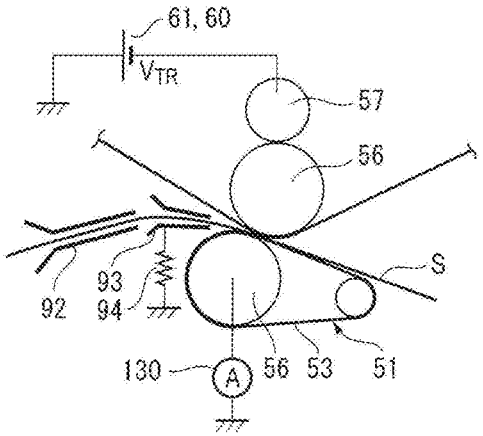
FIG. 11A Related Art
FIG. 11A is an explanatory diagram illustrating an example of a measurement circuit for the transfer current in the secondary transfer unit when low-resistance paper passes through the transfer region of the secondary transfer unit in Comparative Example 1.

Comparative Example 1 embodies the image forming device according to Comparative Embodiment 1 (see FIGS. 9A to 9C). As illustrated in FIG. 11A, the transfer voltage $V_{TR}$ provided by the normal transfer power source 61 only is applied irrespectively of the paper type, without using the assisted transfer power source 62 as the transfer power source 60. Note that in FIG. 11A, structural elements similar to Comparative Embodiment 1 are denoted with similar signs, and detailed description thereof will be omitted.

In Comparative Example 1, a current meter 130 is connected between the elastic transfer roller 55 of the belt transfer module 51 and ground, the transfer voltage $V_{TR}$ provided by the normal transfer power source 61 is applied to the secondary transfer region TR, an imaging process is performed under the imaging conditions of forming a halftone image of uniform density on the low-resistance paper sheet S, and the current flowing through the current meter 130 while the low-resistance paper sheet S passes through the secondary transfer region TR is monitored.

In Comparative Example 1, as illustrated in FIG. 11A, in the case in which the low-resistance paper sheet S passes through the secondary transfer region TR before the trailing end of the low-resistance paper sheet S has exited the earlier guide chute 92, the transfer current $I_{TR}$ of the secondary transfer region TR flows as a leakage current along a conductive path leading from the earlier guide chute 92 to ground through the low-resistance paper sheet S, and a state is maintained in which the monitor current flowing through the current meter 130 on the belt transfer module 51 side is approximately 0.

At this time, in the secondary transfer region TR, since the transfer current $I_{TR}$ flows from the opposing roller 56 to the low-resistance paper sheet S through the intermediate transfer body 30, a transfer electric field pointing towards the low-resistance paper sheet S acts on the image G on the intermediate transfer body 30, and stable secondary transfer operations are performed.

After that, when the trailing end of the low-resistance paper sheet S exits the earlier guide chute 92, the low-resistance paper sheet S contacts the later guide chute 93, and at this time, assuming that the high resistance 94 of the later guide chute 93 is sufficiently low compared to the impedance of the belt transfer module 51, the transfer current $I_{TR}$ flowing through the secondary transfer region TR flow as a leakage current along a conductive path leading from the later guide chute 93 to ground with the low-resistance paper sheet S acting as a conductive path, and a state is maintained in which the monitor current flowing through the current meter 130 on the belt transfer module 51 side is approximately 0. In this state, if the trailing end of the low-resistance paper sheet S exits the earlier guide chute 92 and reaches the later guide chute 93, the transfer current $I_{TR}$ may change to the extent of the disparity in the resistance condition between the two guide chutes, but in the case in which the transfer current $I_{TR}$ is sufficiently low compared to the impedance of the opposing roller 56 and the intermediate transfer body 30, the amount of change in the transfer current $I_{TR}$ is kept small.

Figure 11B:
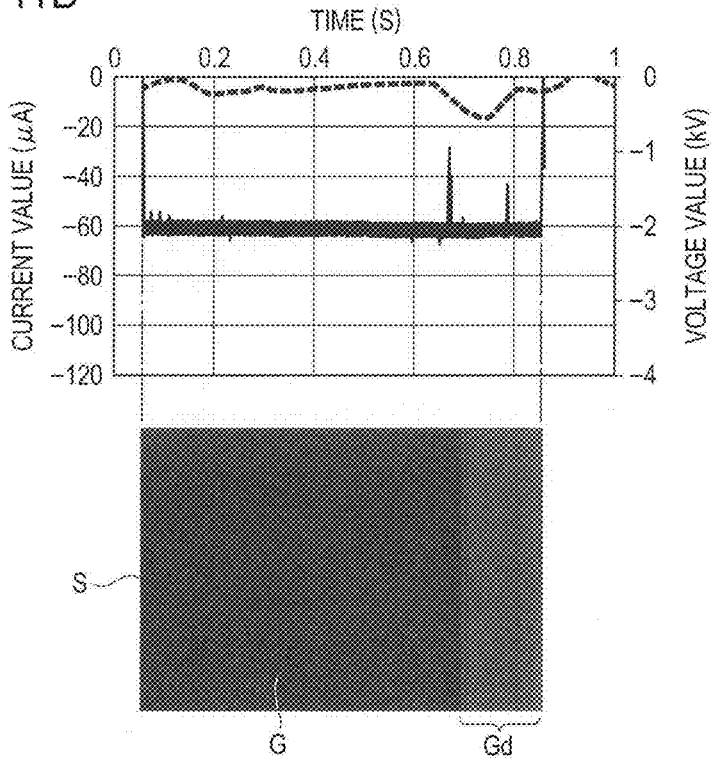
FIG. 11B is an explanatory diagram illustrating an exemplary measurement circuit and exemplary change in the transfer current, and the effect of image formation on low-resistance paper.

After that, when the trailing end of the low-resistance paper sheet S exits the later guide chute 93, the transfer current $I_{TR}$ of the secondary transfer region TR flows along a current path leading from the elastic transfer roller 55 of the belt transfer module 51 to ground via the opposing roller 56 to the intermediate transfer body 30. At this time, since the impedance of the belt transfer module 51 is added as the system resistance of the secondary transfer region TR, as illustrated in FIG. 11B, the monitor current flowing through the current meter 130 (corresponding to the transfer current $I_{TR}$) changes sharply (in this example, to approximately −20 μA) from the level of approximately 0. In this state, the transfer current $I_{TR}$ tends to be insufficient compared to the transfer current $I_{TR}$ in the case in which the low-resistance paper sheet S is stretched between the secondary transfer region TR and the guide chute 92 (93), and thus poor transfer occurs easily near the trailing end of the low-resistance paper sheet S, and there is a risk of producing a density step Gd in the halftone image G of uniform density.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device comprising:

a thin-walled image carrier that movably carries an image formed by charged imaging particles;

a transfer device that includes paired transfer members that sandwich and transport the image carrier and a recording medium, and transfers the image carried on the image carrier in a transfer region sandwiched by the paired transfer members;

a guide member, provided in a grounded state farther upstream in a transport direction of the recording medium than the transfer region of the transfer device, that guides the recording medium to the transfer region; and a transfer power source that causes a transfer electric field to act in the transfer region by imparting a transfer voltage between the paired transfer members, wherein the transfer power source includes a first transfer power source that imparts a first transfer voltage used normally to either one of the paired transfer members, and a second transfer power source that activates together with the first transfer power source when the recording medium has a predetermined resistance value or less, or is of low resistance having a conductive layer along a medium substrate face, the second transfer power source imparting a second transfer voltage of opposite polarity from the first transfer voltage and having an absolute value that is less than or equal to the first transfer voltage to the other of the paired transfer members.

2. The image forming device according to claim 1, further comprising:

a discriminator that discriminates a type of the recording medium running towards the transfer region, wherein whether or not to activate the second transfer power source is decided on a basis of a discrimination signal of the discriminator.

3. The image forming device according to claim 2, wherein the discriminator is a detector that detects a sheet resistance of the running recording medium.

4. The image forming device according to claim 1, wherein the guide member includes a first guide member provided grounded at a site distanced from the transfer region, and a second guide member provided between the first guide member and the transfer region, and provided grounded via a higher resistance than the first guide member.

5. The image forming device according to claim 4, wherein the second guide member is disposed at a position that guides an insertion attitude of the recording medium to the transfer region, and the first guide member is disposed at a different inclination and attitude from the second guide member.

6. The image forming device according to claim 4, wherein the transfer voltage of the second transfer power source is chosen at a level at which current does not flow along a path leading to the high-resistance ground of the second guide member through the recording medium.

7. The image forming device according to claim 1, wherein the transfer power source includes a toggle switch that selectively toggles the second transfer power source with respect to the first transfer power source.

8. The image forming device according to claim 1, wherein the transfer power source includes a cleaning power source that imparts a predetermined cleaning voltage across the paired transfer members when transfer is not being performed, causing a cleaning electric field to act to transfer an image remaining on a transfer member of the paired transfer members positioned opposite an image-carrying face of the image carrier to the image carrier, and the cleaning power source is selectively toggled through a toggle switch when transfer is not being performed.

9. The image forming device according to claim 1, wherein the image carrier is an intermediate transfer body onto which an image on an image-forming carrier is intermediately transferred before being transferred to a recording medium, and the transfer device transfers the image on the intermediate transfer body onto the recording medium.

* * * * *